United States Patent [19]

Laudig et al.

[11] Patent Number: 4,799,902

[45] Date of Patent: Jan. 24, 1989

[54] TRIAXIAL ELECTRICAL CABLE CONNECTOR

[75] Inventors: Ronald C. Laudig, Mechanicsburg; Donald L. Smith, Middletown, both of Pa.

[73] Assignee: AMP Incorporated, Harrisburg, Pa.

[21] Appl. No.: 87,134

[22] Filed: Aug. 19, 1987

[51] Int. Cl.[4] ..... H01R 17/18

[52] U.S. Cl. ..... 439/585; 439/580; 439/751

[58] Field of Search ..... 439/578, 579, 580, 581, 439/582, 583, 584, 585, 675, 732, 733, 738, 744, 746, 751, 873; 29/828, 861, 862, 863

[56] References Cited

U.S. PATENT DOCUMENTS

| | | | |
|---|---|---|---|
| 3,437,960 | 4/1969 | Ziegler, Jr. | 439/578 |
| 4,169,651 | 10/1979 | Hanke | 439/746 |
| 4,231,003 | 10/1980 | Ishimaru | 439/578 |
| 4,255,011 | 3/1981 | Davis et al. | 439/580 |
| 4,307,926 | 12/1981 | Smith | 339/177 R |
| 4,553,806 | 11/1985 | Forney, Jr. et al. | 339/177 R |
| 4,619,496 | 10/1986 | Forney, Jr. et al. | 339/94 C |
| 4,688,878 | 8/1987 | Cohen et al. | 339/177 R |

OTHER PUBLICATIONS

Sample packet of plug-Part Number 227110-1 (AMP, Inc.) 87 02.

AMP, Inc. Instruction Sheet IS 9213 (released 5-2-7-86).

AMP, Inc. Instruction Sheet IS 9324 (released 4-1-0-87).

AMP, Inc. Data Sheet 83-692 (Issued 7-83)-Triax Series RF Connectors.

AMP, Inc. Instruction Sheet IS 2832 (released 8-21-78; rev. 12-24-81).

AMP, Inc. Instruction Sheet IS 2945 (released 4-2-7-84).

AMP, Inc. Instruction Sheet IS 3013 (released 5-2-4-83).

*Primary Examiner*—David Pirlot

[57] ABSTRACT

A triaxial electrical connecter for terminating a triaxial electrical cable. The connector (10) is manufactured to comprise five major components including a center contact (21), intermediate and outer shell subassemblies (22,23), an intermediate ferrule (24) and a bushing (26), which can be easily assembled and attached to the end of a triaxial cable (12). The center contact (21) and the intermediate and outer shell subassemblies (22,23) include captivation structure for automatically aligning the components with respect to one another during the assembly process. The intermediate and outer shell subassemblies (22,23) include intermediate and outer contacts (41,71) and intermediate and outer insulating members (42,72) which are adapted to be press-fit into their respective contacts (41,71) for easy preassembly of the subassemblies (22,23) without specialized tools.

15 Claims, 3 Drawing Sheets

TRIAXIAL ELECTRICAL CABLE CONNECTOR

BACKGROUND OF THE INVENTION

Coaxial and triaxial cables are used in a variety of electronic applications in which electromagnetic shielding is desired to provide noise-free transmission of the signal carried by the central conductor of the cable. Triaxial cables, for example, which contain a center conductor to carry an information-bearing signal and two outer conductors to provide shielding, are often used in applications wherein it is desired to reduce noise levels to a minimum.

Triaxial cables are often terminated by triaxial electrical connectors. Many known triaxial connectors were relatively complicated devices comprised of a large number of loose pieces which were assembled by the user employing either a soldering or a crimping technique when the connectors were attached to triaxial cables. Assembly and attachment of such connectors to cables was a relatively time consuming and, therefore, expensive procedure.

Prior efforts to reduce connector complexity and assembly labor costs included designing the connector to contain one or more subassemblies in which some of the loose pieces were preassembled during manufacture of the connector. The subassemblies reduced the number of loose pieces in the connector, and, therefore, tended to simplify final assembly procedures. Many prior designs, however, were not fully satisfactory. Often, for example, the subassemblies themselves were difficult to assemble thus negating the reduction in labor costs achieved during final assembly.

Also, in many connector designs, it was difficult to ensure that the connector components were properly positioned with respect to one another and, once positioned, that they were maintained in proper position during assembly of the connector onto the cable. In many designs, for example, proper positioning of the electrical contacts in the connector depended on establishing and maintaining proper tension between assembled components by a threaded housing/ coupling nut arrangement; and misalignment of one or more of the electrical contacts frequently prevented the connector from properly mating with its complementary connector.

SUMMARY OF THE INVENTION

The present invention provides an electrical connector for terminating an electrical cable having a center conductor and a plurality of outer conductors.

This invention permits, for example, an electrical connector for triaxial cables to be manufactured which s comprised of only five major components which may be easily assembled and which are automatically aligned with respect to one another during the assembly process. The five components include a center contact, an intermediate ferrule, a bushing and intermediate and outer shell subassemblies; and the subassemblies are themselves designed to be easily preassembled during manufacture of the connector by relatively unskilled personnel without specialized tools.

An electrical connector of the invention comprises a center contact adapted to be electrically coupled to the center conductor of a cable; an intermediate shell subassembly which includes an intermediate contact adapted to be electrically coupled to a first outer conductor of the cable, and an intermediate insulating member for electrically insulating the center contact from the intermediate contact, the intermediate insulating member being supported within the intermediate contact in press-fit relationship therewith; an outer shell subassembly which includes an outer contact adapted to be electrically coupled to a second outer conductor of the cable, and an outer insulating member for electrically insulating the intermediate contact from the outer contact, the outer insulating member being supported within the outer contact in press-fit relationship therewith; means for mounting the center contact within the intermediate shell subassembly; and means for mounting the intermediate shell subassembly within the outer shell subassembly.

In a presently preferred embodiment of the invention, the intermediate and outer contacts and the intermediate and outer insulating members comprise generally tubular-shaped members having axial passageways extending therethrough. The insulating members are adapted to be simply inserted into their respective contacts and are automatically retained therein in proper position by a press-fit relationship established therebetween.

In the presently preferred embodiment, the intermediate insulating member includes a major portion having an outside diameter slightly less than the diameter of the axial passageway of the intermediate contact, and a minor portion which is outwardly stepped to have an outside diameter slightly greater than the diameter of the axial passageway of the intermediate contact and an inside diameter slightly greater than the inside diameter of the major portion. Accordingly, only the minor portion of the intermediate insulating member is actually press-fit within the intermediate contact when the intermediate shell subassembly is assembled; and the stepped construction of the minor portion prevents the intermediate insulating member from being compressed inwardly to an extent that its axial passageway is deformed to prevent the center contact from being readily inserted thereinto during final assembly of the connector.

In accordance with a further aspect of the invention, the outer insulating member is comprised of front and rear sections. The front section has an outside diameter slightly less than the diameter of the axial passageway of the outer contact such that it may be simply slid into the outer contact during preassembly of the outer shell subassembly. The rear section is adapted to be press-fit into the outer contact to automatically retain both outer insulating member sections properly positioned within the outer contact. The rear section may also include an outwardly stepped minor portion in press-fit relationship with the outer contact to prevent excessive deformation of the outer insulating member when it is press-fit into the outer contact.

By providing a simple press-fit relationship between the intermediate and outer insulating members and their respective contacts, accurate preassembly of both the intermediate and outer shell subassemblies is accomplished quickly and easily without the use of specialized tools.

In accordance with a further aspect of the invention, the means for mounting the center contact within the intermediate shell subassembly and the means for mounting the intermediate shell subassembly within the outer shell subassembly comprise first and second captivation means designed into the components for automatically aligning the components with respect to one another during final assembly of the connector to automatically ensure that the contacts are in proper axial alignment with respect to one another when the connector is assembled to the cable.

Thus, the present invention provides a connector having a reduced number of loose pieces, including a pair of easily preassembled subassemblies, which can be assembled and attached to a cable quickly and accurately. The connector includes built-in structures for automatically achieving and retaining proper positioning of the connector components during assembly to a cable to ensure reliable operation of the connector.

Further advantages and specific details of the invention will be set forth hereinafter in conjunction with the detailed description of a presently preferred embodiment.

DETAILED DESCRIPTION OF THE PREFERRED EMBODIMENT

Figure 1:
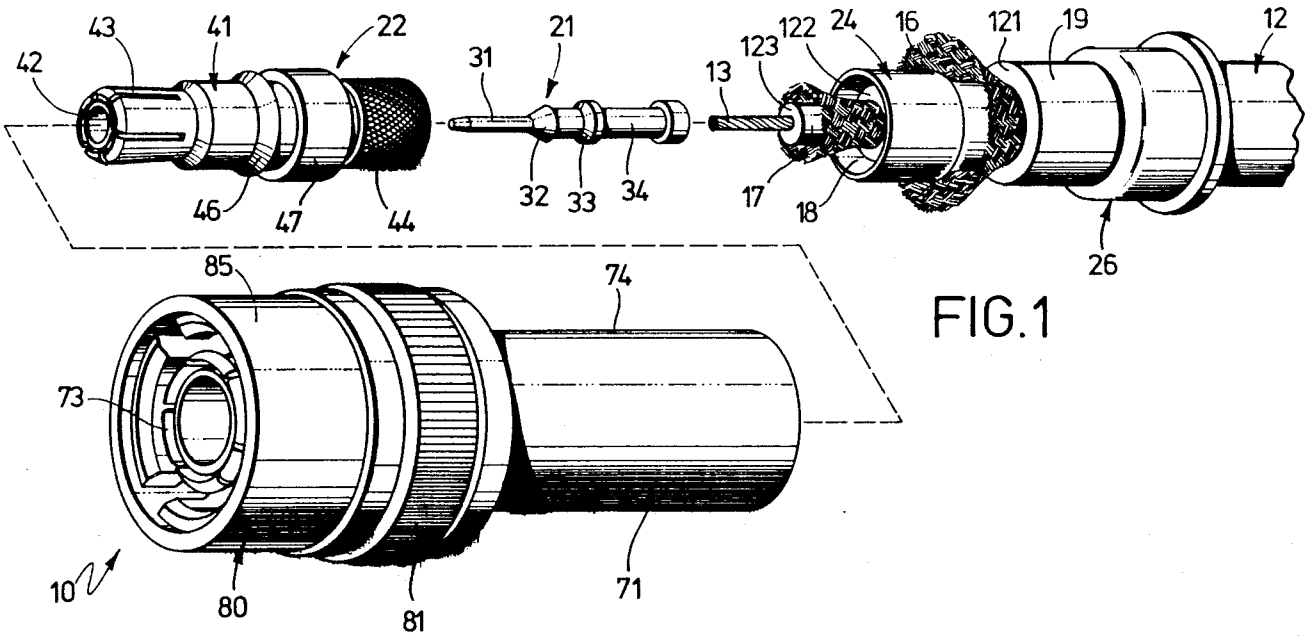
FIG. 1 is a partially exploded, perspective view of a triaxial electrical connector according to a presently preferred embodiment of the invention.

FIG. 1 is a partially exploded, perspective view of an electrical connector according to a presently preferred embodiment of the invention. The connector is generally designated by reference numeral 10 and comprises a triaxial plug connector for terminating a triaxial electrical cable 12. Triaxial cable 12 is of conventional type and includes a center conductor 13, an intermediate conductor 14 and an outer conductor 16. As is known to those skilled in the art, center conductor 13 typically comprises an electrically conductive wire, and the intermediate and outer conductors 14 and 16 comprise annular, braided conductors positioned concentrically around center conductor 13 to provide shielding for the central conductor. The conductors are electrically isolated from one another by insulating layers 17 and 18, and the outer conductor is covered by a jacket 19.

Connector 10 comprises an assembly composed of five components including a center contact 21, an intermediate shell subassembly 22, an outer shell subassembly 23, an intermediate ferrule 24 and a bushing 26. (Ferrule 24 and bushing 26 are shown as being slid onto cable 12 in FIG. 1 for convenience in illustration.) The intermediate and outer shell subassemblies are manufactured as preassembled units, and the subassemblies, the center contact, the intermediate ferrule and the bushing are assembled together during final assembly as the connector is attached to cable 12.

Figures 2A, 2B, 5:
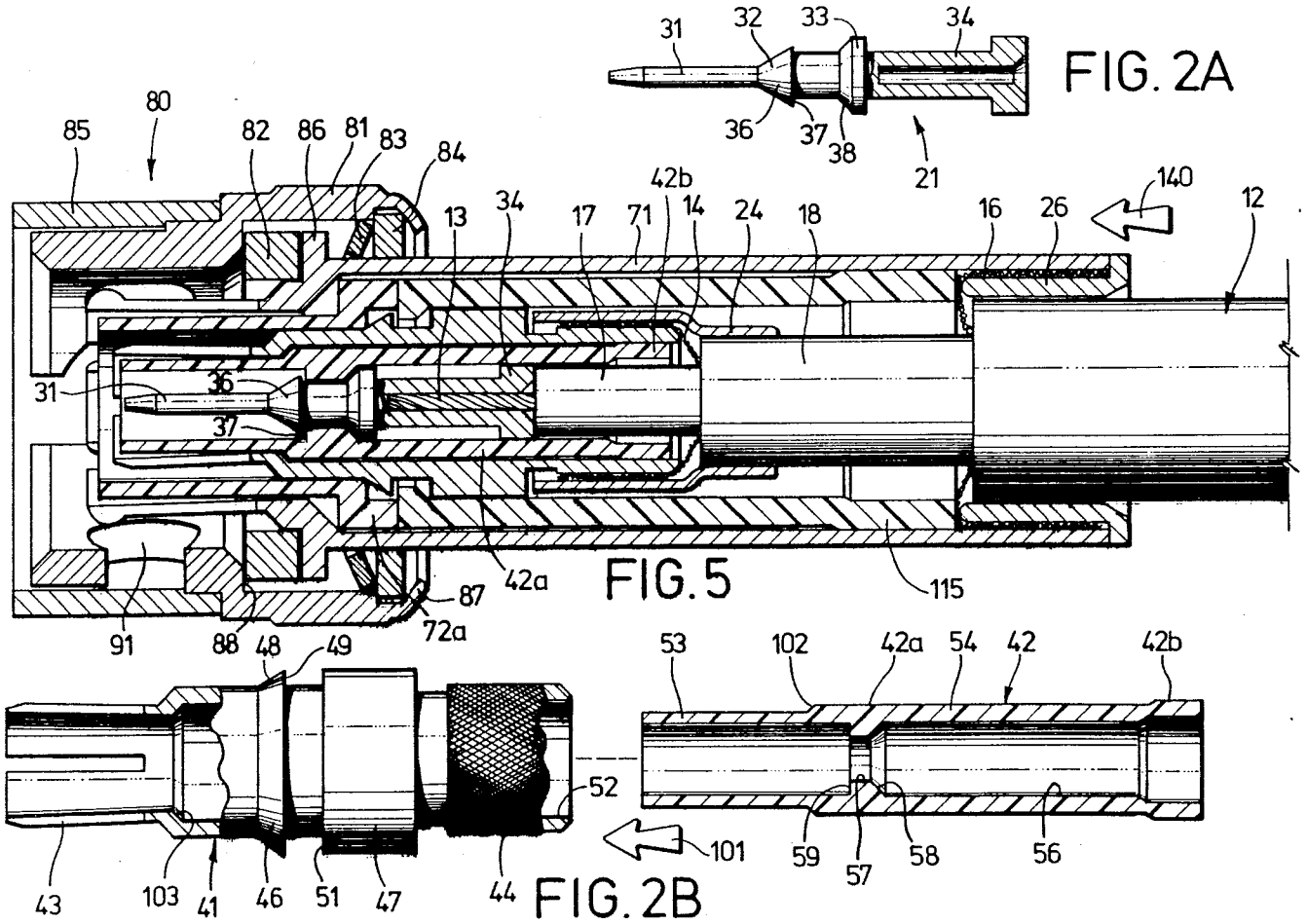
FIG. 2A illustrates the center contact of the connector of FIG. 1.
FIG. 2B illustrates the intermediate shell subassembly of the connector of FIG. 1.
FIG. 5 is a cross-sectional view of the connector of FIG. 1 in fully assembled form.

Center contact 21 is also illustrated in FIG. 2A and includes a front pin portion 31, first and second annular flanges 32 and 33 and a rear, crimpable, barrel portion 34. As will be explained more fully hereinafter, annular flanges 32 and 33 comprise external retention features adapted to cooperate with internal retention features on intermediate shell subassembly 22 to define first captivation means for automatically securing and positioning the center contact within the intermediate shell subassembly during assembly of the connector. First flange 32 has a forwardly facing, tapered surface 36 and a rearwardly facing radial surface 37. Second flange 33 is somewhat larger than flange 32 and has a forwardly facing tapered surface 38.

Intermediate shell subassembly 22 is also illustrated in FIG. 2B and comprises an intermediate contact 41 and an intermediate insulating member 42. Intermediate contact 41 comprises a generally tubular-shaped member having an axial passageway 52 extending therethrough, and includes a forward hood portion 43 and a knurled rearward portion 44. Intermediate contact 41 also includes first and second outwardly extending flanges 46 and 47 which comprise external retention features adapted to cooperate with internal retention features on the outer shell subassembly to define second captivation means for automatically securing and positioning the intermediate shell subassembly within the outer shell subassembly during assembly of the connector. Annular flange 46 includes a forwardly facing tapered surface 48 and a rearwardly facing radial surface 49. Annular flange 47 includes a forwardly facing radial surface 51.

Intermediate insulating member 42 comprises a generally tubular-shaped member formed of a suitable dielectric material such as Teflon or the like. Insulating member 42 includes a forward portion 53 adapted to surround pin portion 31 of center contact 21 when the connector 10 is assembled, and a rear portion 54 adapted to substantially surround barrel portion 34 of the center contact. Intermediate insulating member 42 has an axial passageway 56 extending therethrough and includes a generally centrally positioned inwardly extending annular flange 57 having a rearwardly facing tapered surface 58 and a forwardly facing radial surface 59. Flange 57 defines internal retention features which comprise a portion of the first captivation means for securing and positioning the center contact 21 within intermediate shell subassembly 22.

Intermediate insulating member 42 is adapted to be inserted into and retained within axial passageway 52 of the intermediate contact to define intermediate shell subassembly 22. Insulating member 42 includes a major portion **42*a* having an outside diameter which is slightly less than the diameter of passageway 52 in intermediate contact 41 and a minor portion 42*b* which is outwardly stepped to have an outside diameter which is slightly greater than the diameter of axial passageway 52 and an inside diameter which is slightly greater than the diameter of the remainder of the axial passageway 56 in insulating member 42. As shown in FIG. 2B, minor portion 42*b* is preferably located adjacent the back edge of intermediate insulating member 42**.

Minor portion **42*b* of intermediate insulating member 42 is adapted to retain the insulating member within intermediate contact 41 by establishing a press-fit relationship therebetween when the intermediate insulating member 42 is inserted into passageway 52 of intermediate contact 41** as will be explained hereinafter.

Figure 2C:
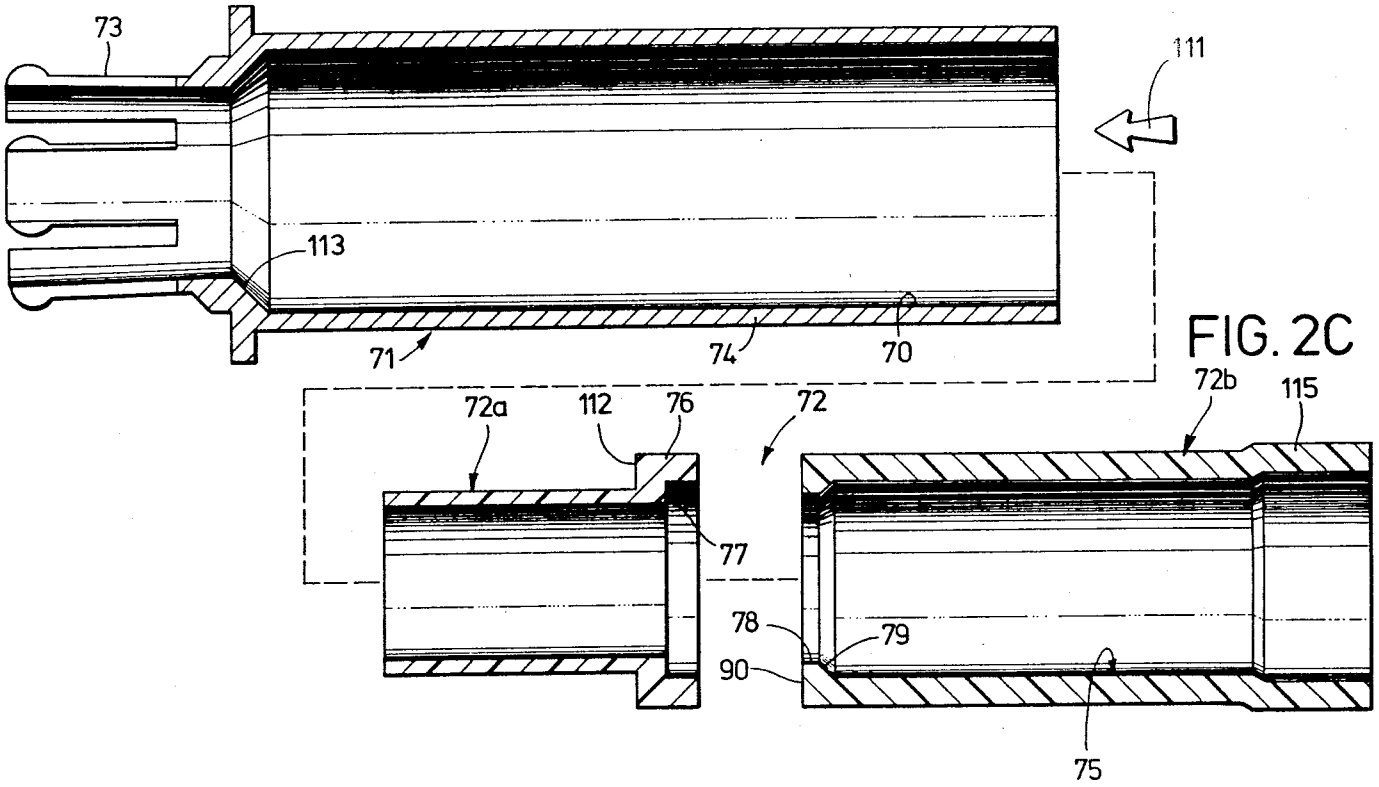
FIG. 2C illustrates the outer shell subassembly of the connector of FIG. 1.

Outer shell subassembly 23 is also illustrated in FIG. 2C and includes an outer contact 71 and an outer insulating member 72. Outer contact 71 comprises a tubular-shaped member having an axial passageway 70, and includes a forward contact portion 73 adapted to mate with the outer contact in a complimentary electrical connector (not shown), and a sleeve portion 74.

Outer insulating member 72 comprises a tubular-shaped member of suitable dielectric material such as Teflon or the like having an axial passageway 75, and is composed of separate front and rear sections 72*a* and 72*b*. Front section 72*a* includes an outwardly stepped portion 76 defining a rearwardly facing radial shoulder 77 adjacent the back end thereof. Rear section 72*b* includes an inwardly extending flange 78 adjacent its front end which has a tapered rearwardly facing surface 79 thereon. When the outer insulating member sections are assembled during preassembly of outer shell subassembly 23, stepped portion 76 on front section 72*a* and flange 78 on rear section 72*b* define internal retention features adapted to cooperate with the external retention features on the intermediate contact to define the second captivation means for automatically securing and positioning the intermediate shell subassembly within the outer shell subassembly during final assembly of the connector.

Intermediate ferrule 24 comprises a generally tubular-shaped member having a forward portion which is adapted to extend over outer knurled surface 44 of intermediate contact 41 to clamp the intermediate conductor 14 of cable 12 therebetween. Bushing 26 is adapted to extend into axial passageway 70 of outer contact 71 to clamp the outer conductor 16 of cable 12 therebetween as will be explained hereinafter.

Outer shell subassembly 23 also includes structure for coupling connector 10 to a complementary electrical connector (not shown), as is known to those skilled in the art. In the embodiment illustrated and described herein, the coupling structure comprises bayonet-type coupling structure which is adapted to be connected to mating bayonet-type coupling structure on the complementary connector. Bayonet-type couplers are well-known in the art (see, for example; U.S. Pat. Nos. 4,307,926 and 4,165,911) and, therefore, are not described in detail herein. Briefly, and as best shown in FIG. 5, the coupler is generally designated by reference numeral 80 and includes a collar 81, a gasket 82, an annular spring washer 83, a locking washer 84 and an annular sleeve 85.

As shown, outer contact 71 is adapted to extend into collar 81. Annular spring washer 83 and locking washer 84 are positioned around the outer contact 71 rearward of annular flange 86 extending radially therefrom, and gasket 82 is positioned forward of flange 86. A locking lip 87 at the rear of collar 81 engages washer 84 to secure the spring and lock washers within the assembly and to prevent removal of the coupling structure 80 from the outer contact in one axial direction. An internal shoulder 88 on collar 81 retains gasket 82 between shoulder 88 and flange 86 and prevents removal of the coupling structure from the outer contact in the opposite axial direction.

Collar 81 is rotatably mounted to outer contact 71 and includes camming slots 91 which are adapted to releasably engage locking pins on the bayonet-type coupler on the complementary connector as is known in the art. Sleeve 85 surrounds the forward portion of the collar to cover the outside of the slots and provide the collar with a smooth, external appearance.

Intermediate shell subassembly 22 and outer shell subassembly 23 are adapted to be preassembled during the manufacture of connector 10. The intermediate shell subassembly is preassembled by simply inserting intermediate insulating member 42 into axial passageway 52 of intermediate contact 41 in the direction indicated by arrow 101 in FIG. 2B until forwardly facing shoulder 102 on the insulating member impinges rearwardly facing shoulder 103 on the intermediate contact. The outwardly stepped, minor portion 42*b* of intermediate insulating member 42 presses against the inner surface of passageway 52 to establish a press-fit relationship therebetween to reliably retain and position the intermediate insulating member within the intermediate contact. The outwardly-stepped construction of minor portion 42*b* prevents axial passageway 56 of intermediate insulating member 42 from being deformed by the press-fit to such an extent that center contact 21 cannot be properly inserted thereinto during final assembly of the connector as will be described hereinafter.

Outer shell subassembly 23 is preassembled by attaching coupling structure 80 around outer contact 71 as shown in FIG. 5, and by inserting the outer insulating member 72 into the axial passageway 70 of the outer contact. Initially, front section 72*a* of outer insulating member 72 is inserted into outer contact 71 from the rear thereof as shown by arrow 111 in FIG. 2C until the front surface 112 of flange 76 impinges upon internal surface 113 on the outer contact. The outside diameter of section 72*a* is preferably smaller than the diameter of passageway 70 such that it will easily slide thereinto. Rear insulating section 72*b* is then inserted into outer contact 71 in the direction of arrow 111 until it impinges upon front section 72*a*. Rear insulating section 72*b* has an outside diameter sized to be press-fit into passageway 70 to firmly retain and position both insulating sections within the outer contact 71. If desired, section 72*b* can also be provided with an outwardly stepped minor portion 115 at the rear end thereof as shown in FIG. 2C such that only the minor portion 115 will be in press-fit relationship with outer contact 71 to prevent deformation of passageway 75 of outer insulating member section 72*b* to an extent that can prevent proper insertion of intermediate shell subassembly 22 into outer shell subassembly 23 during final assembly of the connector.

Figure 3:
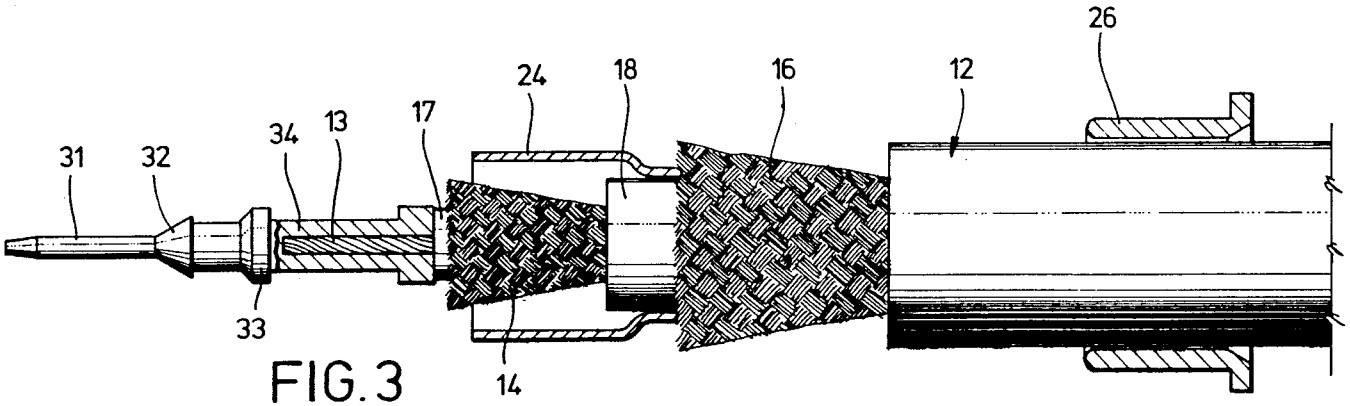

The procedure for final assembly of connector 10 and for simultaneously mounting connector 10 to triaxial cable 12 will now be described with reference to FIGS. 1 and 3–5. Initially, cable 12 is prepared by removinq a portion of outer jacket 19 at 121 (FIG. 1) to expose the outer braided conductor 16. A lesser portion of the outer insulating layer 18 is then removed as shown at 122 to expose a portion of intermediate braided conductor 14. Finally, a portion of the inner insulating layer 17 is removed at 123 to expose a length of center conductor 13. After preparation of the cable, bushing 26 is slid over the outer cable jacket 19, and intermediate ferrule 24 is slid over the exposed portion of outer insulating layer 18 and beneath outer conductor 16 as shown in FIG. 1. Center conductor 13 is then inserted into barrel portion 34 of Center contact 21 as shown in FIG. 3, and the barrel portion is crimped onto the center conductor as known to those skilled in the art.

Figure 4:
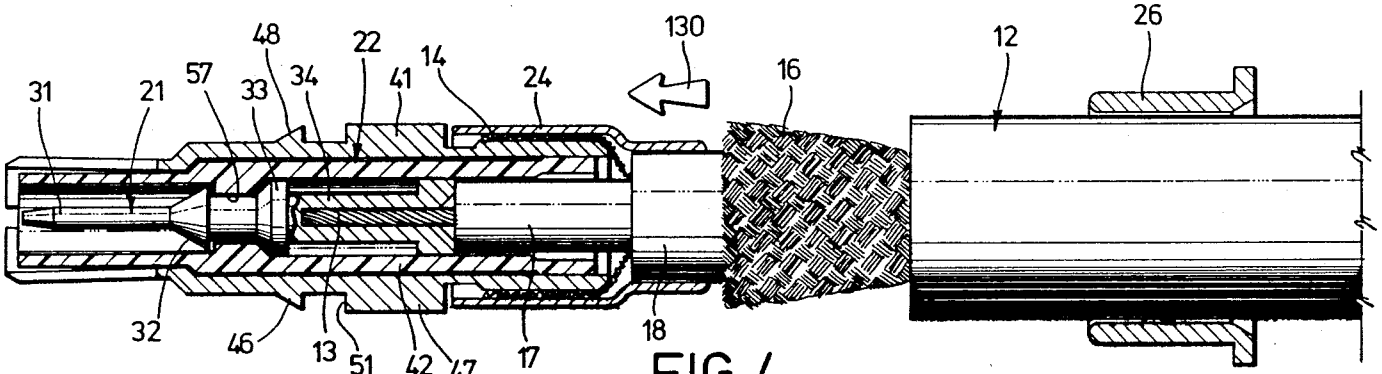
FIGS. 3 and 4 illustrate steps in the assembly of the connector of FIG. 1.

Center contact 21 is then inserted into intermediate shell subassembly 22 from the rear end thereof as indicated by arrow 130 in FIG. 4. Insertion of the center contact into axial passageway 56 of intermediate insulating member 42 continues until the center contact automatically locks into position within the intermediate shell subassembly. In particular, during insertion, pin portion 31 of center contact 21 extends through reduced diameter flange 57 of axial passageway 56. As insertion continues, the tapered front surface 36 of first flange 32 of center contact 21 impinges against internal tapered surface 58 on intermediate insulating member 42. Because of the resilient nature of the insulating member, the reduced diameter flange 57 of the intermediate insulating member deforms sufficiently to permit flange 32 to pass therethrough to the position illustrated in FIG. 4. Immediately thereafter, the larger and less tapered second flange 33 on center contact 21 impinges against surface 58 of intermediate insulating member 42 to prevent further forward movement of the center contact within axial passageway 56. Rearward movement of the center contact within intermediate shell subassembly 22 is also prevented by rearward facing surface 37 on the first flange 32 of center contact 21 impinging against forwardly facing surface 59 on the intermediate insulating member 42. The center contact 21 is thus automatically locked within the intermediate shell subassembly in proper axial alignment with respect thereto.

Intermediate ferrule 24 is then slid forwardly over the inner braided conductor 14 and the rear end of intermediate shell subassembly 22 and crimped around the outer knurled outer surface 44 of the intermediate contact to firmly secure the inner braided conductor 14 therebetween as shown in FIG. 4.

Intermediate shell subassembly 22 is then inserted into outer shell subassembly 23 from the rear thereof as indicated by arrow 140 in FIG. 5. Insertion continues until the forwardly facing tapered surface 48 on first annular flange 46 of the intermediate contact 41 impinges upon internal surface 79 of flange 78 on outer insulating member section **72*b*. The outer insulating member is capable of deforming sufficiently to allow first flange 46 to pass through flange 78 to the position shown in FIG. 5. Further forward movement of the intermediate shell subassembly into passageway 75 of outer insulating member 72 is prevented by the front surface 51 of second flange 47 on intermediate contact 41 impinging upon surface 79 of flange 78 of outer insulating member 72. Rearward movement of the intermediate shell subassembly within passageway 75 is also prevented by rear surface 49 of first flange 46 impinging against surface 90 of insulating member 72*b***.

The inner and outer shell subassemblies are thus automatically locked together with the intermediate and outer contacts in correct axial alignment with respect to one another.

Bushing 26 is then slid forwardly to capture the outer braided conductor 16 between the outer surface of the bushing and the inner surface of the outer contact 71 as shown in FIG. 5. The outer contact is then crimped to the bushing to firmly secure the outer conductor therebetween to complete assembly of the connector.

The present invention thus provides a triaxial connector which can be rapidly assembled and attached to the end of a triaxial cable with the components of the connector automatically properly positioned relative to one another. Attachment can be made rapidly using conventional crimping tools with a reduced number of rejects and decreased labor costs.

While what has been described constitutes a presently preferred embodiment of the invention, it should be recognized that the invention could take numerous other forms. For example, although a plug triaxial connector is illustrated and described herein, a receptacle connector according to the invention can be assembled and attached to the end of a cable in a substantially identical manner. Because the invention can take various other forms, it should be understood that the invention should be limited only insofar as is required by the scope of the following claims.

We claim:

1. An electrical connector for terminating an electrical cable having a center conductor and a plurality of outer conductors comprising:

a center contact for electrical coupling to said center conductor of said cable;

an intermediate shell subassembly in the form of a first preassembled unit, said intermediate shell subassembly including an intermediate contact for electrical coupling to a first outer conductor of said cable, and an intermediate insulating member for electrically insulating said center contact from said intermediate contact, said intermediate insulating member being press-fitted within said intermediate contact so as to form said first preassembled unit;

an outer shell subassembly in the form of a second preassembled unit, said outer shell subassembly including an outer contact for electrical coupling to a second outer conductor of said cable, and an outer insulating member for electrically insulating said intermediate contact from said outer contact, said outer insulating member being press-fitted within said outer contact so as to form said second preassembled unit;

said intermediate contact and said intermediate insulating member comprising generally tubular-shaped members having axial passageways extending therethrough, said intermediate insulating member being positioned within said axial passageway of said intermediate contact, said intermediate insulating member having a first portion having an outside diameter which is less than the diameter of the axial passageway of said intermediate contact, and a second portion comprising an outwardly stepped portion having an inside diameter slightly greater than the inside diameter of said first portion, and having an outside diameter which is slightly greater than the diameter of said axial passageway in said intermediate contact, wherein only said second portion of said intermediate insulating member is press-fitted within said intermediate contact;

said outer contact and said outer insulating member also comprising generally tubular-shaped members having axial passageways extending therethrough;

said outer insulating member being positioned within said axial passageway of said outer contact;

said outer insulating member comprising a first front insulating section adapted to be easily received within said axial passageway o said outer contact, and a second rear insulating section adapted to be received within said axial passageway of said outer contact in press-fit relationship therewith;

first captivation means on said center contact and on said intermediate shell subassembly for securing said intermediate shell subassembly as a unit together with said center contact;

said first captivation means fixing the position of said center contact within said intermediate shell subassembly;

second captivation means on said intermediate shell subassembly and on said outer shell subassembly for securing said intermediate shell subassembly as a unit together with said outer shell subassembly as a unit;

said second captivation means fixing into position said intermediate shell subassembly within said outer shell subassembly;

an intermediate ferrule disposed between said first outer conductor and said outer shell subassembly for securing said first outer conductor to said intermediate shell subassembly;

a bushing for securing said second outer conductor to said outer shell subassembly;

said second portion of said intermediate insulating member comprises a minor portion of said intermediate insulating member;

and said minor portion comprises an outwardly stepped portion also having an inside diameter which is slightly greater than the inside diameter of a major portion.

2. The connector of claim 1 wherein said second captivation means comprises first and second flanges spaced apart from each other on said intermediate contact, and a projection extending from said outer insulating member into the space between said first and second flanges of said intermediate contact, said first flange cooperating with said projection to permit mounting of said intermediate shell subassembly in said outer shell subassembly and to prevent movement in one direction, said second flange cooperating with said projection to prevent movement in an opposite direction.

3. The connector of claim 1 wherein said rear insulating section comprises a major portion having an outside diameter which is slightly less than the diameter of said axial passageway of said outer contact and a minor portion having an outside diameter which is slightly greater than the diameter of said axial passageway of said outer contact whereby only said minor portion of said rear insulating section is press-fit within said outer contact.

4. The connector of claim 1 wherein said connector comprises a triaxial connector for terminating a triaxial cable.

5. The connector of claim 1 wherein said first captivation means comprises first and second flanges spaced apart form each other on said center contact, and a projection extending from said intermediate insulating member into the space between said first and second flanges, said first flange cooperating with said projection to permit mounting of said center contact in said intermediate shell subassembly and to prevent movement in one direction, said second flange cooperating with said projection to prevent movement in an opposite direction.

6. The connector of claim 5 wherein said first flange is made from a resilient material and comprises snap-lock means.

7. The connector of claim 1 wherein said minor portion is located adjacent the rear end of said intermediate insulating member.

8. The connector of claim 7 wherein said first captivation means comprises snap-lock means on said center contact and a cooperating projection on said intermediate insulating member for automatically axially aligning said center contact within said intermediate shell subassembly.

9. The connector of claim 1 wherein said minor portion of said outer insulating member is located adjacent the rear end of said rear section of said outer insulating member.

10. The connector of claim 1 wherein said second captivation means comprises snap-lock means on said first and second outer insulating sections, and a cooperating projection on said intermediate contact for automatically axially positioning said intermediate shell subassembly within said outer shell subassembly.

11. The connector of claim 1 wherein said outer shell subassembly further includes coupling means for coupling said connector to a complimentary connector.

12. The connector of claim 11 wherein said coupling means comprises bayonet-type coupling means.

13. The connector of claim 1 wherein said first captivation means comprises first and second flanges spaced apart form each other on said center contact, and a projection extending from said intermediate insulating member into the space between said first and second flanges, said first flange of said center contact cooperating with said projection of said intermediate insulating member to permit mounting of said center contact in said intermediate shell subassembly and to prevent movement in one direction, said second flange of said center contact cooperating with said projection of said intermediate insulating member to prevent movement in an opposite direction.

14. The connector of claim 13 wherein said first flange is made from a resilient material and comprises snap-lock means.

15. The connector of claim 13 wherein said second captivation means comprises first and second flanges spaced apart from each other on said intermediate contact, and a projection extending from said outer insulating member into the space between said first and second flanges of said intermediate contact, said first flange of said intermediate contact cooperating with said projection of said outer insulating member to permit mounting in said outer shell subassembly and to prevent movement in one direction, said second flange of said intermediate contact cooperating with said projection of said outer insulating member to prevent movement in an opposite direction.

* * * * *